United States Patent [19]

Schuster

[11] Patent Number: 4,941,624

[45] Date of Patent: Jul. 17, 1990

[54] WRAP-AROUND CARRIER WITH HANDLE

[75] Inventor: Richard L. Schuster, Monroe, La.

[73] Assignee: Manville Corporation, Denver, Colo.

[21] Appl. No.: 417,344

[22] Filed: Oct. 5, 1989

[51] Int. Cl.[5] ..... B65D 5/46

[52] U.S. Cl. ..... 229/117.13; 206/140; 206/427

[58] Field of Search ..... 206/427, 428, 434, 429, 206/161, 140, 158; 229/40, 117.13, 117.16

[56] References Cited

U.S. PATENT DOCUMENTS

| | | | |
|---|---|---|---|
| 2,296,228 | 9/1942 | Powell | 229/117.21 |
| 3,123,278 | 3/1964 | Morgan et al. | 229/117.13 |
| 3,156,377 | 11/1964 | Wysocki | 206/140 |
| 3,338,394 | 8/1967 | Hennessey | 206/427 |
| 3,373,867 | 3/1968 | Wood | 206/140 |
| 3,698,625 | 10/1972 | Graser | 206/161 |
| 4,295,598 | 10/1981 | Calvert | 206/428 |
| 4,405,078 | 9/1983 | Dutcher et al. | 229/117.13 |
| 4,728,025 | 3/1988 | Oliff | 206/427 |
| 4,728,026 | 3/1988 | Schuster | 229/117.13 |
| 4,836,375 | 6/1989 | Schuster et al. | 206/427 |

*Primary Examiner*—Gary Elkins
*Attorney, Agent, or Firm*—John D. Lister

[57] ABSTRACT

A wrap-around bottle carrier with short end panels and reinforced side and top panels formed by folded-under edge flaps. Tuck flaps connected to the edge flaps permit folding of the edge flaps. Neck retainer openings are provided in the top panel and in the folded-under top panel edge flaps. The side panels include short angled portions adjacent the top panel. One of the side panels contains a handle opening extending from the adjacent bottom panel into the adjacent angled portion. The carrier can be lifted by means of either the handle or the ends of the top panel.

27 Claims, 4 Drawing Sheets

WRAP-AROUND CARRIER WITH HANDLE

FIELD OF THE INVENTION

This invention relates to wrap-around article carriers. More particularly, it relates to a wrap-around article carrier capable of carrying heavy loads and to an integral handle for lifting and carrying a heavy carrier.

BACKGROUND OF THE INVENTION

Wrap-around carriers commonly utilized in the beverage industry to package bottles of beer and soft drinks are typically positioned on moving upright bottles in a packaging machine so that neck holes in the blanks fit over the necks of the bottles, after which the blanks are folded into place around the moving bottles. The ends of the blanks are usually fastened to each other at the bottom of the carrier by locking tabs and apertures, and a handle arrangement, such as finger openings or an integrally formed strap, is located on the top panel of the carrier to enable a user to lift and carry the package with one hand.

Because carriers of this type are best adapted for packages containing relatively few bottles, such as six or eight, an improved carrier designed to carry a greater number of heavy bottles, such as twelve bottles of 16-fluid ounce size, was developed. Such a carrier, which is disclosed in U.S. Pat. No. 4,836,375, issued on June 6, 1989, not only does away with the usual open-case carrier formed of heavier paperboard, but provides a fully enclosed package with all its advantages. The package provides for a double thickness of paperboard at the edges of the top panel to enable a user to grasp the carrier at the reinforced edges in order to lift it. Although this is a convenient way of lifting and handling the package, it was found that there is still a surprisingly strong consumer demand for a carrier of this type which can be lifted with one hand in order to free the other hand for other tasks.

To provide the carrier with a handle capable of withstanding the severe stresses involved in lifting a very heavy package would appear to require the use of considerably heavier paperboard or paperboard which has been significantly reinforced. Since this is to be avoided for economic reasons it would seem that a carrier of this type could not practically be provided with a handle enabling the package to be lifted with one hand. It is, nevertheless, an object of the invention to provide such a carrier with a handle which can be used to safely lift the heavy package without damaging it and without danger of the bottles falling out. Moreover, it is a further object to provide a carrier and handle arrangement of this type which is economical to manufacture.

BRIEF SUMMARY OF THE INVENTION

This invention comprises a carrier having side panels and end panels foldably connected to a bottom panel. In a preferred form of the invention, for use with bottles, the upper portions of the side panels adjacent the top panel are angled to conform generally to the tapered neck portions of the bottles and are connected to a top panel. At least one of the side panels contains a handle opening comprising two elongated spaced edges extending transversely thereof between the angled portion of the side panel and the bottom panel. The handle opening preferably extends into the adjacent angled upper side portion and into the adjacent bottom panel. This arrangement is sufficiently strong to permit the carrier to be lifted by the handle without using thicker, more expensive paperboard or reinforced paperboard.

In addition to a handle opening being provided for lifting the carrier, the top panel of the carrier is provided with folded-under end flaps which permit the carrier to be lifted by the end portions of the top panel.

In addition, reinforcement flaps foldably connected to the side panels may be integrally formed with the top panel reinforcement flaps to strengthen the end portions of the side panels as well. The side panel reinforcement flaps are connected to the end panels by tuck flaps which allow the formation of upstanding end panels and folded-under side panel reinforcement flaps. The top panel is also provided with bottle neck retainer openings which assist in supporting the package when the handle opening is used to lift the carrier. Preferably, the top panel reinforcement flaps may contain at least one bottle neck retainer opening aligned with a bottle neck retainer opening in the top panel.

In addition, the distance between the fold lines connecting the tuck flaps to the end panels is less than the distance between the side edges of the bottom panel, and the angle formed by the diagonal fold line with the fold lines connecting the tuck flaps to the end panels is less than 45°. This causes the end panels to be biased inwardly to resist any tendency of the bottles to be pushed out the end panels, particularly when the carrier is lifted by the side panel handle opening.

If the carrier is used to package beverage cans which have no tapered neck portion, the angled side panel portions need not be provided, in which case the handle opening would extend from the top panel to the bottom panel.

Other features and aspects of the invention, as well as other benefits thereof, will readily be ascertained from the more detailed description of the preferred embodiment which follows.

DETAILED DESCRIPTION OF THE PREFERRED EMBODIMENT

Figure 1:
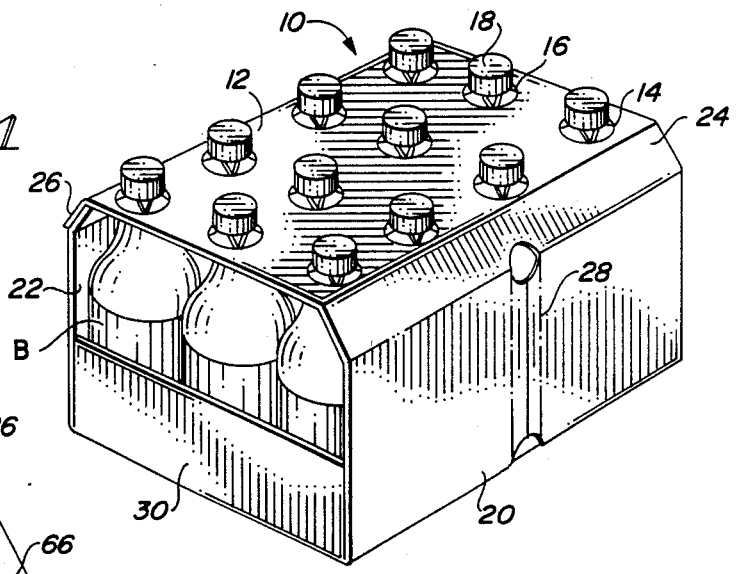
FIG. 1 is a pictorial view of the carrier of the present invention as it would appear in normal resting condition supported on the bottom panel.

Referring to FIG. 1, a carton 10 formed according to the invention comprises a top panel 12 containing a number of spaced openings 14 through which the top portions of the necks of bottles B extend. Tabs 16, which are foldably connected to the perimeters of the openings, extend up from the top panel 12 and engage the bottom edges of the bottle caps 18 to assist in holding the bottles in place.

The top panel 12 is connected to side panels 20 and 22 by short sloping side panel portions 24 and 26, and a handle 28 is provided in the side panel 20. In addition, a bottom panel, not visible in this view, is connected to the side panels 20 and 22 and to partial or short end panels 30. This design enables the bottle labels to be seen through the open end spaces between the top panel and the short end panels, which is advantageous for product identification and for illustrating the size of the bottles, yet the end panels are large enough to provide adequate space for additional printed advertising or other indicia and to hold the end bottles in the carrier.

Figure 2:
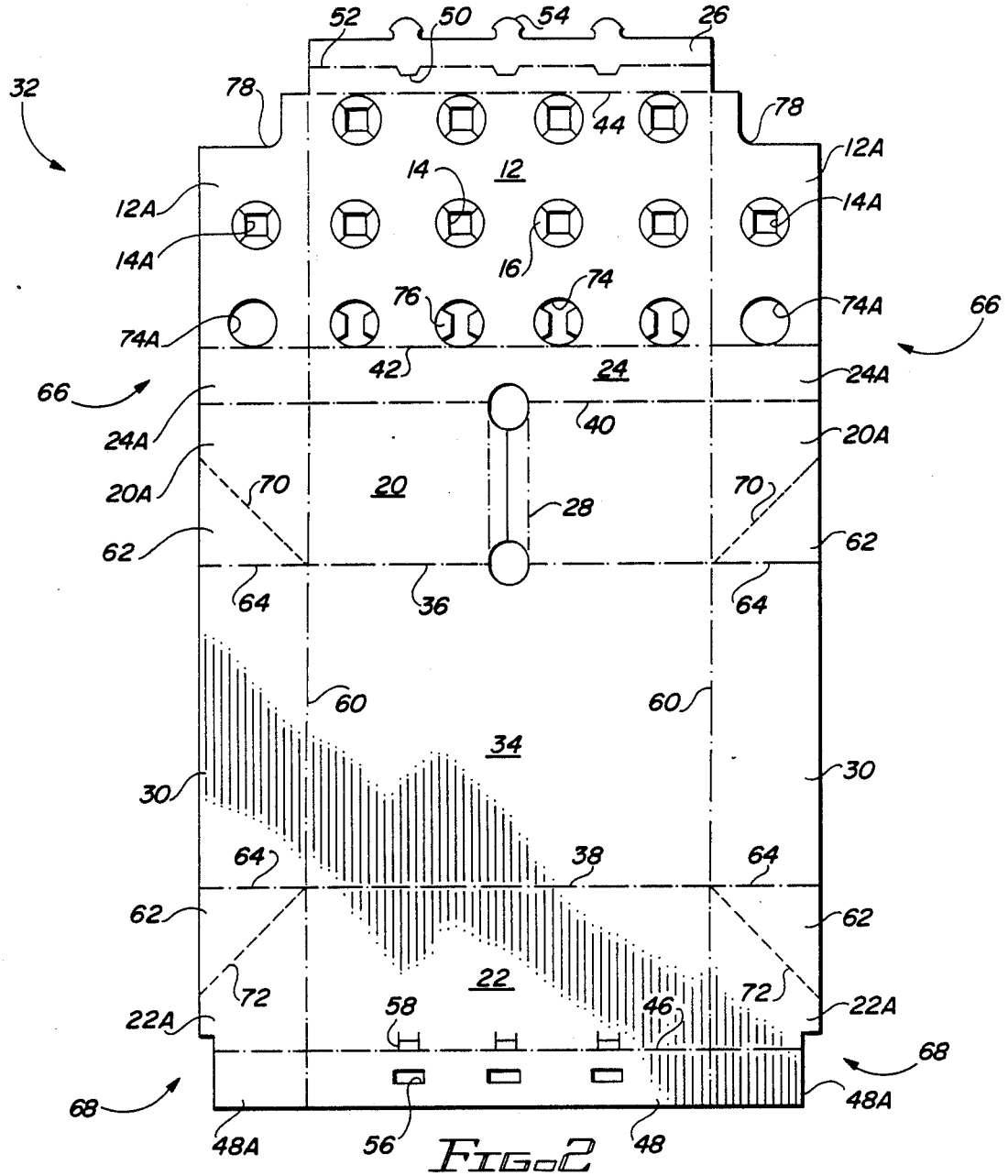
FIG. 2 is a plan view of a blank from which the carrier of the present invention is fabricated.

Referring to FIG. 2, a production blank for forming the carrier of FIG. 1 is indicated generally by reference numeral 32. The production blank 32 is comprised of a bottom section 34 connected by score lines 36 and 38 to side panel sections 20 and 22, respectively. The side panel section 20 is connected by a score line 40 to angled side panel section 24, which is connected by score line 42 to top panel section 12. The top panel section 12 is connected by a score line 44 to top fastening strip 26, and the side panel section 22 is connected by a score line 46 to a side fastening strip 48. The top fastening strip 26 contains primary male locking tabs 50, the bases of which are generally aligned with score line 52, and secondary male locking tabs 54 which are aligned with the primary locking tabs 50. In like manner the fastening strip 48 contains primary female locking apertures 56 aligned with the locking tabs 50, and the side panel section 22 contains secondary female locking apertures 58 extending from the score line 46. The secondary locking apertures 58 are aligned with the secondary locking tabs 54.

Connected to the bottom section 34 along score lines 60 are end panel sections 30, corresponding to the end panels 30 of the carrier of FIG. 1, which are connected to tuck flaps 62 by score lines 64. The score lines 64 in this arrangement are extensions of the score lines 36 and 38. The score lines 60 extend beyond the bottom panel section 34 to the ends of the blank, forming reinforcement flaps 66 and 68. The reinforcement flaps 66 are comprised of reinforcement flap sections 12A, 24A and 20A, which are connected by the score lines 60 to the top panel section 12, the angled side panel section 24 and the main side panel section 20, respectively. The reinforcement flaps 68 are comprised of reinforcement flap sections 22A and 48A, which are connected by score lines 60 to side panel section 22 and side fastening strip 48, respectively. Two of the tuck flaps 62 are connected to reinforcement flaps 20A by fold lines 70, while the other tuck flaps 62 are connected to the reinforcement flaps 22A by fold lines 72. The score lines 60 are generally perpendicular to the score lines 38, 36, 40, 42, 44 and 46 so as to result in a carrier having panels that extend generally at right angles to each other. In the arrangement shown, the fold lines 70 and 72 form an angle of 45° with the score lines 60 and 64.

Still referring to FIG. 2, the top panel section 12 contains twelve neck retainer openings arranged in three rows of four openings each. The openings 14 in the outer two rows include four tabs 16 foldably connected to the top panel section which enables the necks of bottles contained in the carrier to protrude through the openings and yet be engaged substantially entirely around the periphery of the neck below the bottle cap to hold the neck in place. The openings 74 in the innermost row of openings are larger in a transverse direction than the openings 14, and are provided with only two tabs 76 which, like the tabs 16, are foldably connected to the top panel section. The larger opening with fewer neck retainer tabs facilitates the closing of the top panel of the carrier over the bottles to be packaged, as will be more clear later. In addition, each of the reinforcement flaps 12A contains a neck retainer opening 14A and a neck retainer opening 74A. As illustrated, the openings 14A preferably are identical to the openings 14, while the openings 74A preferably are identical in shape and size to the openings 74 but are not provided with neck retaining tabs in order to further facilitate the closing of the top panel over bottles to be packaged. The reinforcement flaps 12A are further provided with cutout portions 78 which take up the space in which neck retainer openings similar to openings 14A could have been located, and reinforcement flaps 48A and 22A are provided with cutout portions adjacent their outer edges. These cutout portions facilitate the folding of the blank by eliminating some of the paperboard in congested areas where paperboard folds would otherwise come together and where the extra thicknesses of such paperboard are not necessary to the functioning of the carrier.

Figure 3:
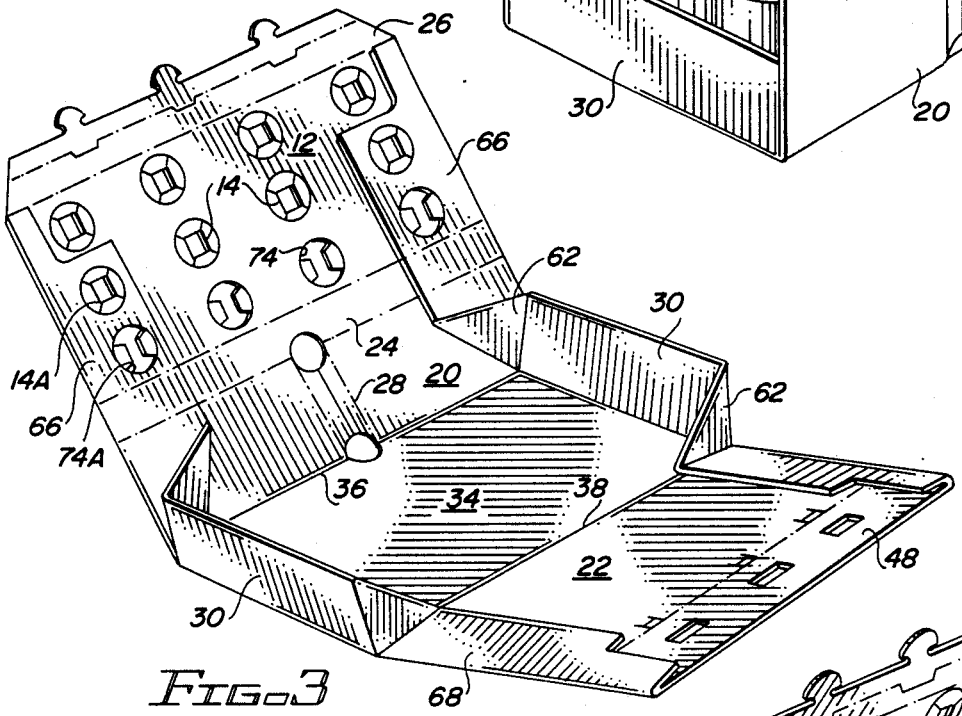
FIG. 3 is a pictorial view of the blank of FIG. 2 in a partially folded state, the bottles about which the blank is folded being omitted for purpose of clarity.

Referring to FIGS. 2 and 3, and assuming that the surface of the blank facing the viewer in FIG. 2 is the inside surface of the blank, the first step in folding the blank 32 to form a carrier is to push the tuck flaps 62 upward and toward the score lines 64. This causes the paperboard to fold along the fold lines 70 and 72, moving the fold lines up out of the plane of the blank and raising the end panel sections 30 and the reinforcement flaps 66 and 68. It also causes the side panel section 22 and the fastening strip section 48 to be hinged up as a unit about score line 38, and the side panel section 20, the angled section 24, the top panel section 12 and the fastening strip 26 to be hinged up as a unit about the score line 36. The reinforcement flaps 66 and 68 are continued to be folded about score lines 60 until they overlie the adjacent panel sections as shown in FIG. 3. The neck retainer openings 14A and 74A are aligned with and overlie the end openings 14 and in the adjacent rows of openings to allow the necks of the bottles to protrude through both openings. It should be understood that although bottles are not shown in FIG. 3 so as not to interfere with the illustration of the carrier components, in actual practice the bottles to be packaged would first be positioned on the bottom section of the blank, after which the folding would proceed as outlined above.

Figure 4:
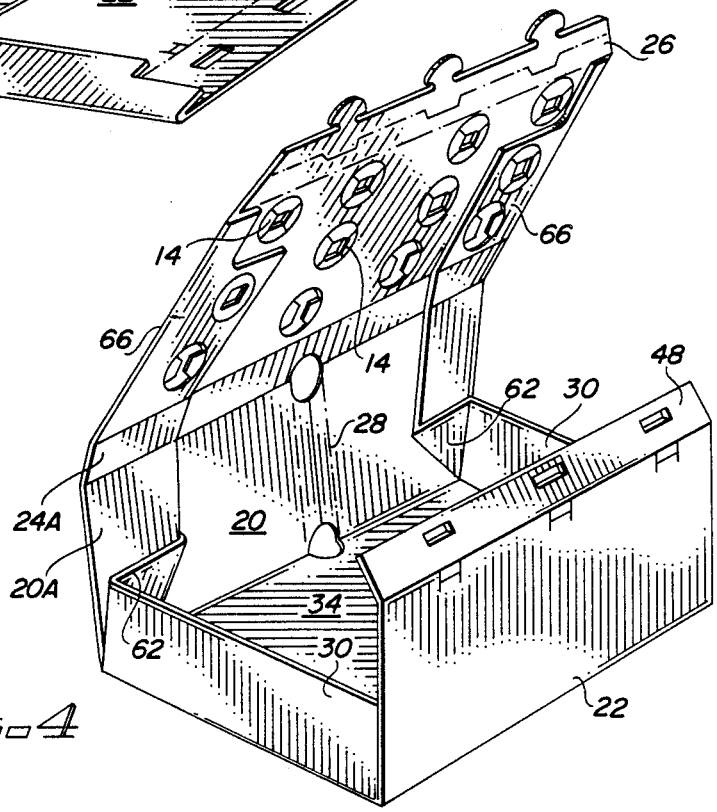
FIG. 4 is a pictorial view similar to that of FIG. 3, but showing the blank in a later stage of fabrication.

The blank, still in the intermediate form of FIG. 3, is continued to be folded along score lines 38 and 36 to bring the side panel sections 22 and 20 up to vertical, and is also folded about score lines 40 and 42 to form the intermediate configuration shown in FIG. 4. The tuck flaps 62 at this point are face to face with the adjacent portions of the reinforcement flaps 22A and 20A, and the top panel section 12 is in the process of being folded down over the bottles which would be sitting on the bottom section. At this point it can be seen that if the top panel of the carrier were connected directly to the side panel without being separated by the angled section 24, there would be no room for the top panel section to be pivoted down over the top of the adjacent row of bottles. Similarly, if the neck retainer openings 74 were the same size as the other close- fitting openings 14, the arc through which the openings 74 move as the top panel section is pivoted downwardly over the tops of the bottles would be too short to enable the openings 74 to be moved over the bottle necks. The angled panel section 24 and the enlarged neck openings 74 thus allow the top panel section 12, and all the neck retainer openings therein, to be properly aligned with the bottles as the top panel section is folded down over the bottles. In order to be certain that the neck retainer openings 74A in the reinforcement flap 12A do not interfere with the movement of the top panel during this folding operation, all neck retainer flaps on these openings preferably are omitted as shown.

Further downward folding of the top panel section is continued until the fastening strip 26 overlies the fastening strip 48 and then is connected thereto to form the finished carier shown in FIG. 1. The angled panel 24 and the angled panel formed from the combined fastening strips 26 and 48 form the same angle with the main side panel portions so that the carrier is symmetrically arranged. The end panels 30 are held in erect vertical position by the folded tuck flaps. The bottles in the carrier, which are tightly packed and abut the side panels 20 and 22, also abut the tuck flaps, pushing against them and pinning them against the adjacent folded-over reinforcement flaps 20A and 22A. Thus the bottles in the package assist in holding the tuck flaps in position.

The individual folded-over reinforcement flaps which make up the reinforcement flaps 66 and 68 provide a double thickness of paperboard along the edges of the top panel of the carrier, thereby strengthening the top panel to permit a user to grasp the underside of the top panel adjacent its edges and lift the carrier.

Figure 5A:
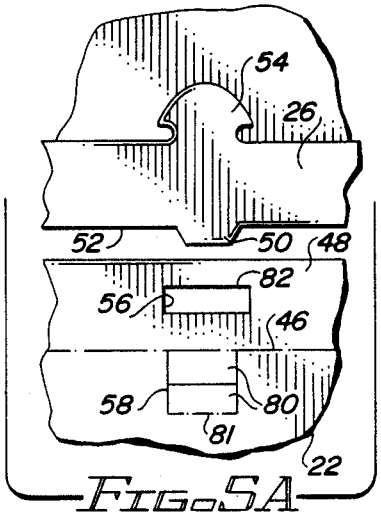
FIGS. 5A, 5B and 5C are enlarged partial side views of the locking means for securing the fastening strips of the carrier in place, sequentially showing the main steps in the locking process.
Figure 5B:
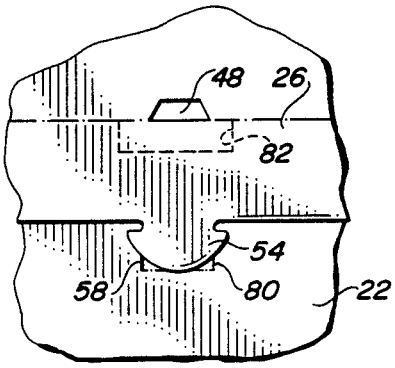
Figure 5C:
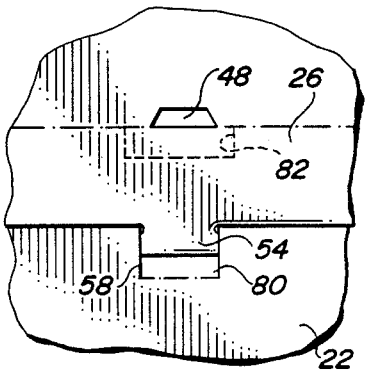
Figure 5D:
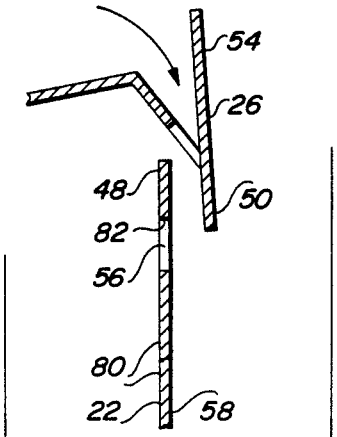
FIGS. 5D, 5E and 5F are enlarged partial sectional views taken through the center of the locking tabs shown in FIGS. 5A, 5B and 5C, respectively, and corresponding to the locking stages illustrated therein.
Figure 5E:
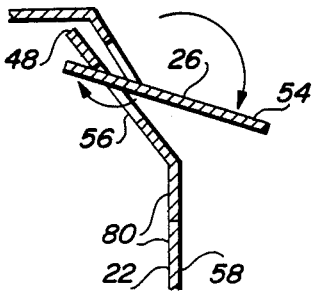

Referring now to FIGS. 5A and 5D, the fastening strip 26 is shown as it is ready to engage the fastening strip 48. The strip 26 has been folded back along the score line 52 so that the underside of the strip 26 is exposed while the outer side of the fastening strip 48 is seen. This separates the primary locking tabs 50 from the strip 26. The primary locking tab 50 is aligned with the primary locking aperture 56, and the secondary locking tab 54 is aligned with the secondary locking aperture 58. The locking aperture 58 is preferably covered by tabs 80 foldably connected to the side panel 22 along fold line 81 and to the score line 46. To complete the primary lock, the locking tab 50 is inserted into the aperture 56 and the strip 26 is folded back down along the score line 52, as best illustrated in FIG. 5E. This causes the tab 50 to pivot about the edge 82 of the aperture 56 and to come to rest face to face with the inside surface of the strip 48. The secondary or punch tab 54 at this point is aligned with the secondary aperture 58, as illustrated in FIG. 5B.

Figure 5F:
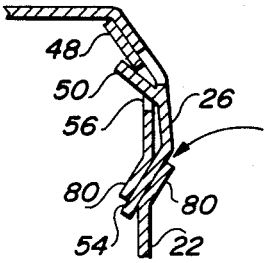

The next step in locking the locking strips together is to insert the punch tab 54 into the aperture 58, forcing the tab through the slightly narrower opening between the foldable tabs 80. This step completes the locking operation so that the strips are connected, as shown in FIGS. 5C and 5F, by both the primary and secondary locks. It should be understood that while this is the preferred locking arrangement because of its holding power under heavy loads, other mechanical locking designs could be used instead, so long as they are capable of securely holding the locking strips together. If preferred, however, the strips could be glued together instead of being mechanically interlocked. If even more locking integrity is required, both a mechanical lock and glue could be employed in the same package.

Figure 6:
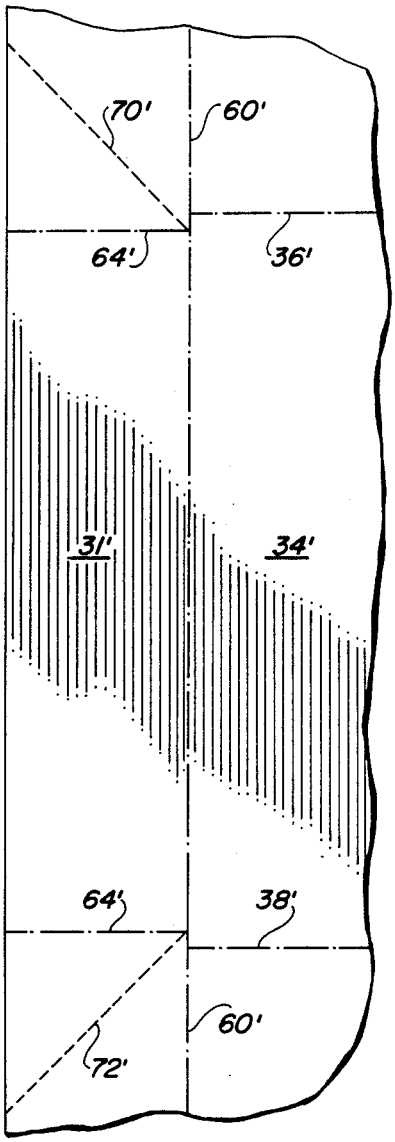
FIG. 6 is an enlarged partial plan view of a portion of a modified blank, showing the intersection of the bottom and end panel score lines.

In the description of the tuck flaps in connection with the blank of FIG. 2, the fold lines 70 and 72 which form the tuck flaps 62 were described as forming an angle of 45° with the score lines 60 and 64. This is the normal arrangement of tuck flaps, and results in the end panel 30 being generally vertically disposed. In FIG. 6 a modified arrangement is shown wherein the score lines 64′ are offset from the score lines 36′ and 38′ so that the distance between the score lines 36′ and 38′ is greater than the distance between the score lines 64′. In addition, instead of the fold lines 70′ and 72′ making 45° angles with the score lines 60′ and 64′, the fold lines 70′ and 72′ form an angle less than 45° with the score lines 64′ and an angle greater than 45° with the score lines 60′ . With this arrangement the end panel 30′ tends to bow slightly inwardly toward the contents of the carrier after the package has been fabricated. This guards against slack end panels and the consequent problem of the end bottles sliding within the package and bumping adjacent bottles. The specific angles and offsets that may be used will vary with the size of the package and the amount of inward bias desired, with greater offsets being required with greater angular departures from 45° . It should be understood, however, that the rectilinear arrangement of the panels does not permit large variations from the FIG. 2 embodiment. A preferred design, for example, combines a 3/32 inch offset with a 43° acute angle formed by score lines 64′ with fold lines 70′ and 72′. In such an arrangement the obtuse angle formed by score line 60′ with fold lines 70′ and 72′ would be 47° so that the sum of the acute and obtuse angles is always substantially 90° .

Figure 7:
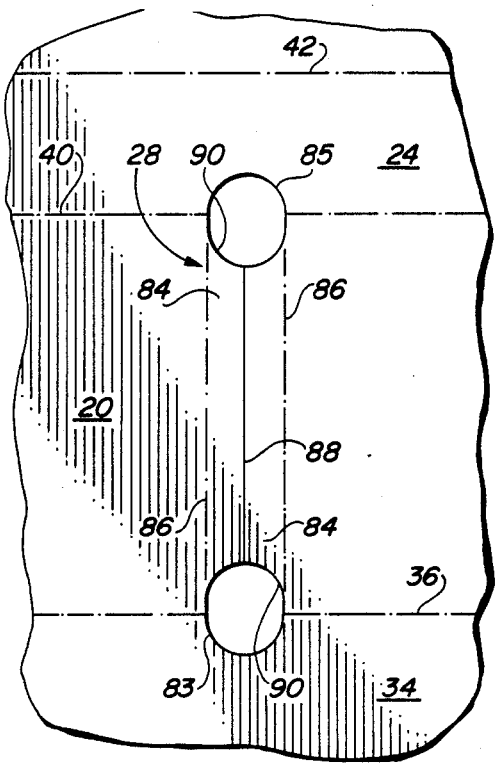
FIG. 7 is an enlarged partial plan view of the blank of FIG. 2, showing the handle arrangement in more detail.
Figure 8:
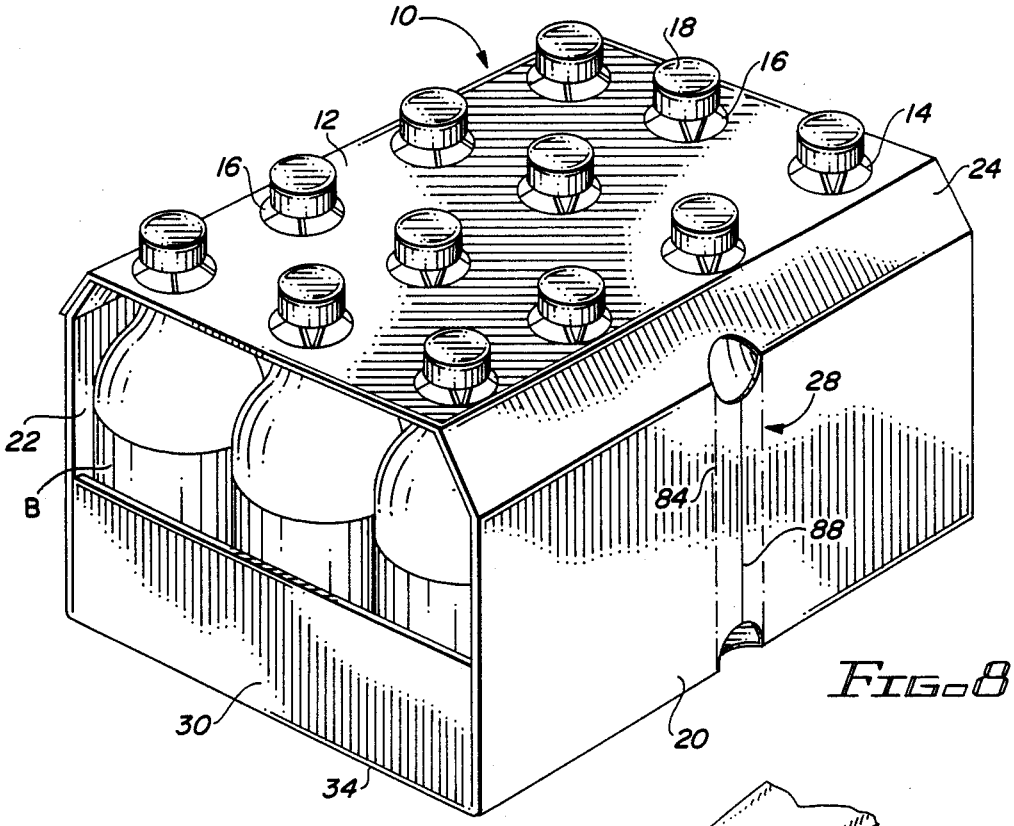
FIG. 8 is a pictorial view of the carrier of the present invention similar to that of FIG. 1, but in greater detail.

Referring now to FIG. 7, which shows the handle arrangement of FIG. 2 in more detail, it can be seen that the handle 28 comprises an opening which extends beyond the score line 36 into the bottom panel section 34 at 83 and beyond the score line 40 into the angle section 24 at 85. The extensions 83 and 85 are arcuate in shape and preferably are in the form of a semi-circle whose diameter is aligned with the adjacent score line 36 and 40. When the blank is formed into a carrier the portions of the handle opening located in the upper regions of the side panel 34 and the short angled side panel portion 24 are the semi-circular cutouts, as best shown in FIG. 8.

As shown in FIG. 7, handle flaps 84 cover a substantial portion of the handle opening and are foldably connected to the side panel section 20 along the elongated edges 86 of the handle opening. The opposite or adjacent edges of the flaps 84 meet in the center of the handle opening along slit 88. Preferably the edges are connected together in the blank by widely spaced sections of uncut paperboard, not shown, which can readily be broken or torn when the fingers of a user are inserted into the handle opening of a carrier formed from the blank.

Preferably the ends of the fold lines of the flaps 84 are spaced a short distance from the score lines 36 and 40, with the slit 88 terminating short of the score lines. As a result the flap edges 90 connecting the free edges of the flaps 84 to their fold lines 86 are angled or curved fairly sharply away from the score lines 36 and 40. This creates substantial areas in the handle opening adjacent the score lines 36 and 40 which are uncovered by the handle opening flaps 84. Although this arrangement is not essential to the stress distribution phenomenon discussed hereinafter, it is beneficial in several respects. It eliminates stock at a point which could interfere with the stripping of the blank from the press and it provides a visual guide to the user as to where the handle opening is and how it should be used. In addition, the shorter free edge of the flap provides less resistance to movement of the flap past underlying bottles which may be packed tightly up against the side panel 20.

Figure 9:
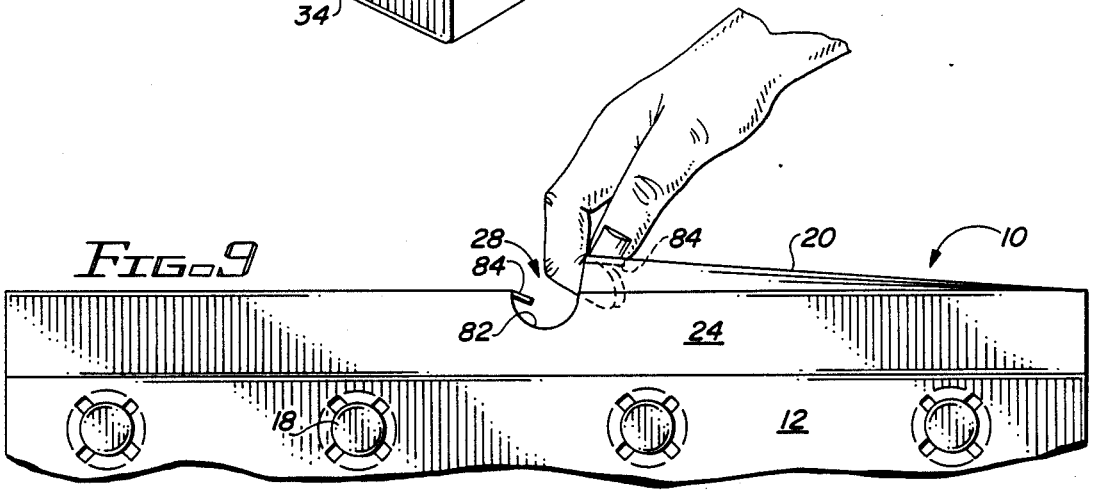
FIG. 9 is a partial side view of the carrier of the invention shown in the process of being lifted by the hand of a user.
Figure 10:
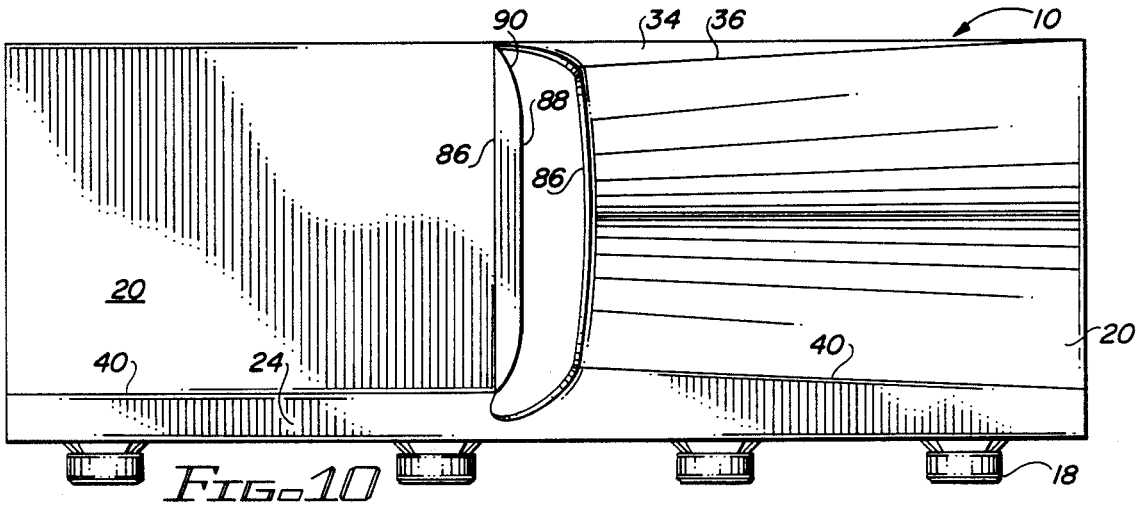
FIG. 10 is a top view of the carrier of FIG. 9, with the hand of the user being eliminated for the sake of clarity.

Referring to FIG. 9, this view shows the distortion of the panel 20 that occurs when a user lifts the carrier by the handle. The handle opening is illustrated as facing upwardly, as it would if the carrier is resting on the side panel 22. It will be appreciated that although the carrier would typically rest on its bottom panel, the user, in grasping the handle while the carrier is resting on its bottom panel, will normally tilt the carrier up so that the panel 20 and the handle 28 are in the position shown in FIG. 9 before the user actually lifts the carrier. In that position, when the fingers press down on one of the flaps 84 the other flap 84 is contacted by the back of the fingers and is thereby folded downwardly a distance sufficient to allow the fingers to enter the handle opening. The first flap is engaged by the pads of the fingers and is folded down about its fold line. Continued pressure against the first flap folds it up against the underside of the panel 20, as shown in dotted lines. As the user begins lifting the carrier, the lifting action causes the engaged side panel portion to bow upwardly, while the unengaged side panel portion remains flat. When this happens, the stresses created at the ends of the handle opening cause the arcuate edges to distort inwardly toward each other. As shown in FIG. 10, the flap 84 attached to the left side of the handle opening has been pushed or folded downwardly enough to allow entry of the fingers into the handle opening. The elongated edge at the right side of the opening is shown in bowed condition and the folds 36 and 40 are shown as having been distorted inwardly in the region of the handle opening, pulling the upper portions of the adjacent angled side panel 24 and the adjacent perpendicular bottom panel 34 inwardly also. The smooth uniform upward bowing of the side panel 20 indicates a uniform distribution of the lifting stresses, avoiding a concentration of stresses in any one area and thus avoiding tearing of the paperboard.

It will be understood that the distortions illustrated occur generally similarly at opposite sides of the main side panel portion 20 along the fold lines 36 and 40 and at both ends of the handle opening, even though one end of the main side panel portion 20 is substantially perpendicular to the bottom panel 34 while the other end forms an angle substantially greater than 90° with the short angled side panel portion 24. Thus although the handle opening extends into adjacent panels at different angles, the distribution of stresses throughout the main side panel portion 20 and the resistance of the ends of the handle opening to tearing are surprisingly similarly to what the expected results would be if both panels 24 and 34 extended at right angles to the main side panel portion 20.

By extending transversely of the main side panel portion 20 and completely across its width, the handle is capable of lifting the heavy carrier without requiring the carrier to be formed from reinforced paperboard or paperboard of greater caliper. The arcuate shape of the handle opening ends prevents the lifting stresses from tearing the ends of the handle opening. It has been found that the off-center location of the handle resulting from the top panel of the carrier lying in a plane spaced from the closest end of the handle opening has little or no impact on the ability of the handle to lift the carrier or on the stress distribution pattern. The fact that the handle is lightly off center with respect to the overall extent of the side panel is not discernible during lifting and carrying of the carrier. The carrier appears instead to be uniformly balanced.

While a strong connection between the angled side panel portion 24 and the attachment strip 48 is essential in preventing the side panel 22 from becoming detached while the carrier is being lifted or carried by the handle 28 and allowing bottles to fall from the carrier, the overall ability of the carrier to carry such a heavy load is believed to be favorably affected by the penetration of the necks of the bottles through the openings in the top panel 12. The edges of the neck openings and the surrounding neck retainers apparently function as additional bottle support surfaces when the carrier is lifted and carried by the handle 28, thereby relieving some of the load bearing requirements from the side panel 22. Additionally, the tight fit of the angled portions of the side panels against the adjacent bottles and the bowing in of the end panels in the manner previously described assist in maintaining the bottles in place when the handle is used to lift the carrier.

Although the preferred embodiment has been described in connection with a handle opening that extends through the fold lines connecting the side panel 20 with the bottom panel 34 and the angled side panel portion 24, the handle opening may be made shorter, if desired, so that it terminates in the side panel 20 short of the fold lines 36 and 40. Such an arrangement is feasible if the side panel 20 is wide enough to allow the handle opening to be of sufficient size for the fingers of a user to enter when lifting and carrying the carrier. The side panel 20 in such a design would bow up during lifting much in the same manner as shown in FIG. 10.

Although the carrier of the present invention is more convenient to lift due to the arrangement of the transverse handle opening and the manner in which the side panel containing the handle opening distorts to permit easy finger access into the opening, the carrier nevertheless may, if desired, be lifted by the reinforced edge portions of the top panel formed by the underturned flap of the top panel.

It should be understood that while the preferred embodiment has been disclosed for use in connection with bottles, the idea of alternatively utilizing folded reinforcement flaps or a side panel handle as a means for lifting the package can apply to cans also. In such a design the angled panel connecting the top panel to the side panel need not be incorporated since there would be no need to extend the arc of the top panel in order to properly align neck retainer openings with bottle necks. The top panel could in such a case extend at right angles from the side panel, and the handle opening would extend across the side panel and into the adjacent top and bottom panels. If required, portions of the top panel could be struck down against the tops of the cans to assist in holding the cans in place.

It should now be apparent that although a preferred embodiment of the invention has been described, it is contemplated that those skilled in the art may make changes to certain features of the preferred embodiment without altering the overall basic function and concept of the invention and without departing from the spirit and scope of the invention, as defined in the appended claims.

What is claimed is:

1. A wrap-around article carrier, comprising:
a bottom panel having side edges and end edges;
side panels connected to the side edges of the bottom panel by fold lines;
end panels connected to the end edges of the bottom panel by fold lines;
a top panel connecting the side panels;
at least one of the side panels having an angled upper portion adjacent the top panel, the angled portion forming an obtuse angle with said one side panel and an obtuse angle with the top panel, the angled portion being connected to the top panel; and
said one side panel containing a handle opening comprising two elongated spaced edges extending transversely of said one side panel between the angled portion of said one side panel and the bottom panel, the handle opening being large enough for the fingers of a user to be inserted in order to lift the carrier from the underside of said one side panel adjacent one of the elongated spaced edges of the handle opening.

2. The carrier of claim 1, wherein the handle opening extends into the angled upper portion of said one side panel and into the bottom panel.

3. The carrier of claim 2, wherein each elongated edge of the handle opening is foldably connected to a flap, the edges of the flaps opposite their foldable connections to the elongated handle opening edges meeting intermediate the elongated edges of the handle opening whereby either flap can be pressed down and folded about its foldable connection.

4. The carrier of claim 3, wherein the length of the meeting edges of the flaps is substantially less than the height of said one side panel, whereby substantial portions of the handle opening in said one side panel adjacent the foldable connection between the side panels and the top panel are exposed.

5. The carrier of claim 1, wherein the top panel contains a plurality of neck retainer openings for receiving the necks of bottles contained in the carrier.

6. The carrier of claim 1, wherein end portions of the top panel are folded under to form areas of double thickness of sufficient strength to enable the carrier to be lifted by such end portions of the top panel.

7. The carrier of claim 6, including tuck flaps connected to the end panels along fold lines and side panel end portions connected to the side panels along fold lines, the side panel end portions being connected to the tuck flaps along diagonal fold lines and being folded in to form areas of double thickness, the folded-in portions of the side panels being connected to the folded-under portions of the top panel.

8. The carrier of claim 7, wherein each of the folded-under portions of the top panel contains at least one neck retainer opening, the neck retainer openings of the folded-under portions of the top panel being aligned with neck retainer openings in the top panel.

9. The carrier of claim 1, wherein the top panel has a side edge portion opposite the connection between the top panel and the angled portion of said one side panel, and wherein the side edge portion of the top panel is connected to the other side panel.

10. The carrier of claim 9, wherein the other side panel includes an upper portion forming an obtuse angle therewith, and means on said opposite side edge portion of the top panel mechanically interlocking with means on the upper portion of the other side panel to connect the top panel to the other side panel.

11. The carrier of claim 7, wherein the distance between the fold lines connecting the tuck flaps to the end panels is less than the distance between the side edges of the bottom panel, the angle formed by the diagonal fold lines with the fold lines connecting the tuck flaps to the end panels being less than 45°.

12. The carrier of claim 1, wherein the height of the end panels is substantially equal to the width of the folded-under portions of the side panels.

13. A blank for forming a wrap-around article carrier, comprising:
a bottom panel section;
side panel sections connected to the bottom panel section by score lines;
end panel sections connected to the bottom panel section by score lines;
a top panel section connected to at least one of the side panel sections by a score line, the top panel section having end edges;
at least one of the side panel sections containing a score line substantially parallel to and spaced from the score line connecting the side panel section to the top panel section, the side panel section between the spaced score lines comprising an angled panel in a carrier formed from the blank; and
said one side panel section containing a handle opening comprising two elongated spaced edges extending transversely of said one side panel section between the angled portion of said one side panel section and the bottom panel, the handle opening being large enough for the fingers of a user to be inserted in order to lift the carrier formed from the blank.

14. The carrier blank of claim 13, wherein the top panel section and the other side panel section contain locking means adapted to interlock with each other in a carrier formed from the blank to hold the blank in carrier form.

15. The carrier blank of claim 13, including reinforcement flaps connected to the end edges of the top panel by score lines, the reinforcement flaps being adapted to be folded about their score lines to a position facing the underside of the top panel of a carrier formed from the blank to reinforce the ends of the top panel.

16. The carrier blank of claim 15, including tuck flaps connected to the end panel sections along score lines, and reinforcement flaps connected to the side panel sections along score lines and to the tuck flaps along diagonal fold lines, the side panel reinforcement flaps being further connected to the top panel reinforcement flaps along score lines, the side panel reinforcement flaps being adapted to be folded about the score lines connecting the side panel reinforcement flaps to the side panel sections to a position facing the inside of the side panels of a carrier formed from the blank to reinforce the ends of the side panels.

17. The carrier blank of claim 15, wherein the distance between the score lines connecting the tuck flaps to the end panel sections is less than the distance between the score lines connecting the bottom panel section to the side panel sections, and wherein the angle formed by the diagonal fold lines with the score lines connecting the tuck flaps to the end panel sections is slightly less than 45° and the angle formed by the diagonal fold lines with the score lines connecting the end panel sections to the bottom panel section is slightly greater than 45°, the sum of said angles being substantially 90°.

18. The carrier blank of claim 17, wherein the angle formed by the diagonal fold lines with the score lines connecting the tuck flaps to the end panel sections is about 43° and the angle formed by the diagonal fold lines with the score section is about 47°.

19. The carrier blank of claim 13, wherein the top panel section contains a plurality of neck retainer openings for receiving the necks of bottles contained in a carrier formed from the blank.

20. The carrier blank of claim 13, wherein the elongated spaced edges of the handle opening extend from the score line connecting said one side panel section to the adjacent bottom panel section and adjacent the score line connecting the angled portion of said one side panel section to the the remaining portion of said one side panel section.

21. The carrier blank of claim 20, wherein the handle opening extends into and terminates in the angled portion of said one side panel section and the bottom panel section.

22. The carrier blank of claim 21, wherein the handle opening has end edges which are arcuate in shape.

23. The carrier blank of claim 21, wherein each elongated edge of the handle opening is foldably connected to a flap, the edges of the flaps opposite their foldable connections to the elongated handle opening edges meeting intermediate the elongated edges of the handle opening whereby either flap can be pressed down and folded about its foldable connection, the length of the meeting edges of the flaps being substantially less than the height of said one side panel section, whereby substantial portions of the handle opening in said one side panel section adjacent the score line connecting said one side panel section to the adjacent bottom panel section and adjacent the score line connecting the angled portion of said one side panel section to the remaining portion of said one side panel section are exposed.

24. A wrap-around article carrier, comprising:

a bottom panel having side edges and end edges;

side panels connected to the side edges of the bottom panel by fold lines;

end panels connected to the end edges of the bottom panel by fold lines;

a top panel connecting the side panels;

the top panel including folded-under end portions forming areas of double thickness of sufficient strength to enable the carrier to be lifted by such end portions of the top panel;

tuck flaps connected to the end panels along fold lines and side panel end portions connected to the side panels along fold lines, the side panel end portions being connected to the tuck flaps along diagonal fold lines and being folded in to form areas of double thickness, the folded-in portions of the side panels being connected to the folded-under portions of the top panel;

one of the side panels containing a handle opening comprising two elongated spaced edges extending transversely of said one side panel between the top panel and the bottom panel, the handle opening being large enough for the fingers of a user to be inserted in order to lift the carrier from the underside of said one side panel adjacent one of the elongated spaced edges of the handle opening.

25. The carrier of claim 24, wherein each elongated edge of the handle opening is foldably connected to a flap, the edges of the flaps opposite their foldable connections to the elongated handle opening edges meeting intermediate the elongated edges of the handle opening whereby either flap can be pressed down and folded about its foldable connection.

26. The carrier of claim 25, wherein the length of the meeting edges of the flaps is substantially less than the height of said one side panel, whereby substantial portions of the handle opening in said one side panel adjacent the foldable connection between the side panel and the top and bottom panels are exposed.

27. The carrier of claim 24, wherein the distance between the fold lines connecting the tuck flaps to the end panels is less than the distance between the side edges of the bottom panel, the angle formed by the diagonal fold lines with the fold lines connecting the tuck flaps to the end panels being less than 45°.

* * * * *

UNITED STATES PATENT AND TRADEMARK OFFICE

CERTIFICATE OF CORRECTION

PATENT NO. : 4,941,624

DATED : July 17, 1990

INVENTOR(S) : Richard Lee Schuster

It is certified that error appears in the above—identified patent and that said Letters Patent is hereby corrected as shown below:

Column 11, line 19:
Claim 18, line 5, after "score" insert --lines connecting the end panel sections to the bottom panel--

Signed and Sealed this

Twenty-sixth Day of November, 1991

*Attest:*

HARRY F. MANBECK, JR.

*Attesting Officer*

*Commissioner of Patents and Trademarks*